US005997408A

United States Patent [19]

Bankhead

[11] Patent Number: 5,997,408

[45] Date of Patent: Dec. 7, 1999

[54] TRAINING AID FOR CHIPPING AND PUTTING

[76] Inventor: Sam D. Bankhead, 136 Sunset Way, Seven Lakes North, West End, N.C. 27376

[21] Appl. No.: 09/267,514

[22] Filed: Mar. 12, 1999

Related U.S. Application Data

[63] Continuation-in-part of application No. 09/114,702, Jul. 13, 1998, abandoned, which is a continuation-in-part of application No. 08/049,178, Apr. 19, 1993, abandoned.

[51] Int. Cl.[6] ..... A63B 69/36

[52] U.S. Cl. ..... 473/227; 473/229; 473/232

[58] Field of Search ..... 473/227, 229, 473/232

[56] References Cited

U.S. PATENT DOCUMENTS 5,150,901 9/1992 Stawicki .

5,174,575 12/1992 Leith et al. ..... 473/227 X 5,520,392 5/1996 Foresi et al. .

*Primary Examiner*—George J. Marlo

*Attorney, Agent, or Firm*—James H. Beusse; Holland & Knight LLP

[57] ABSTRACT

A golf training aid for establishing an idealized golf club position and swing path for short golf swings is attachable to a golf club adjacent the club grip. The training aid has a shaped, elongate shaft with one end coupled to the club and an opposite end adapted for positioning through an armpit of a user. A flexible connector couples an upper end of the shaft to its lower end to allow flexing of the shaft as the club is gripped. A sliding tubular member positioned on the upper end of the shaft is placed under the arm of the user to allow the distance between the user's hands and shoulder to vary during the golf swing while maintaining correct alignment of the club.

10 Claims, 2 Drawing Sheets

TRAINING AID FOR CHIPPING AND PUTTING

This application is a continuation-in-part of U.S. Ser. No. 09/114,702, filed Jul. 13, 1998 now abandoned which is a continuation-in-part of U.S. Ser. No. 08/049,178, filed Apr. 19, 1993, now abandoned.

FIELD OF THE INVENTION

This invention pertains to a device to help golfers develop and maintain correct posture and technique for short golf swings, such as used in putting and chipping.

BACKGROUND OF THE INVENTION

This invention relates generally to a training aid for short golf swings such as putting and chipping. In particular, this invention relates to a training aid to improve short golf swings by employing proprioceptive neuromuscular facilitation, i.e., to create "muscle memory" for reproducing a proper stroke. With the use of this aid, the muscles of a golfer are trained to reproducibly generate a proper golf head alignment and pendulum or piston swing, resulting in a more accurate and consistent stroke.

There have been several attempts to develop similar golf aids. Most notably among these is U.S. Pat. No. 5,520,392 to Foresi et al., which discloses a training device for attachment to a putter to promote a pendulum-style swing. This invention includes a rigid, elongated member having a first end attached to the putter and a second end positioned in the user's armpit. Also of note is U.S. Pat. No. 5,150,901 to Stawicki, which discloses a training device for attachment to a golf club to prevent undesired bending of the user's front elbow. This invention includes a harness assembly attachable to the upper portion of a person's body and an elongated tubular golf club swing guiding member having its opposite ends swivelly coupled to the harness assembly and to a golf club, respectively. Stawicki is designed to provide a teaching method for full swings, i.e., for driving or hitting a ball over long distances. As pointed out by Stawicki, the device is not useful for putting since it does not constrain the shoulder/hand relationship.

While the Foresi et al. device is relatively effective to force the user to maintain the proper form during short putting strokes that require a small swing range, it lacks the flexibility needed to be used for longer putting strokes or for short chip shots that require a more substantial swing range. More particularly, when a golfer swings a golf club, the golfer's body rotates about the golfer's spine, causing the distance between the golfer's hands and shoulders to change. If the device cannot adjust accordingly, it forces the shoulder to turn out of a desired plane in order to maintain a constant fixed distance between the hands and shoulder as established by the Foresi apparatus. This action either forces an awkward hand position in order to maintain an on-line stroke or the golfer maintains a comfortable hand position but allows the club to swing off the intended line of travel. Both of these actions defeat the intended purpose of the apparatus.

Golf professionals recognize that the ideal putting stroke has two essential components. First is that the club head travels along the intended path of the golf ball. Second is that the club head should travel parallel to the surface on which the ball rests through at least the ball striking area, i.e., the cub head should not contact the ball with a descending or ascending blow. If one considers the spine as an axle about which the shoulders and arms rotate during the putting stroke, it can be appreciated that the hand-to-shoulder distance will change during the correct putting stroke. Accordingly, what is desired is a training aid that allows for variable hand-to-shoulder distance while guiding the hands and large muscles in the correct putting stroke.

SUMMARY OF THE INVENTION

The present invention comprises a golf training aid useable for teaching a proper stroke for putting and for short chip shots. In one form, the training aid includes an elongated, shaped shaft having one adapted for releasable connection to a shaft of a golf club, such as a putter, and another end adapted for positioning generally through the armpit of a golfer. A slidable tube fits about the another end of the shaft such that the shaft is slidable within the tube to allow variation in the distance between the golfer's hands on the club and the golfer's armpit or shoulder during swinging of the club. The shaft is shaped to allow the golfer to swing the club without interference with the shaft while the shaft guides the swing in a proper plane. The shaft further includes a flexible connector between the one and another ends to allow the shaft to flex or bend to accommodate different size golfers and to relieve stress on the golfer's armpit when the golfer's hands are placed on the golf club.

BRIEF DESCRIPTION OF THE DRAWINGS

For a better understanding of the present invention, reference may be had to the following detailed description taken in conjunction with the accompanying drawings in which.

Identical structures have similar reference numerals across all Figures.

DETAILED DESCRIPTION OF THE INVENTION

Figure 1:
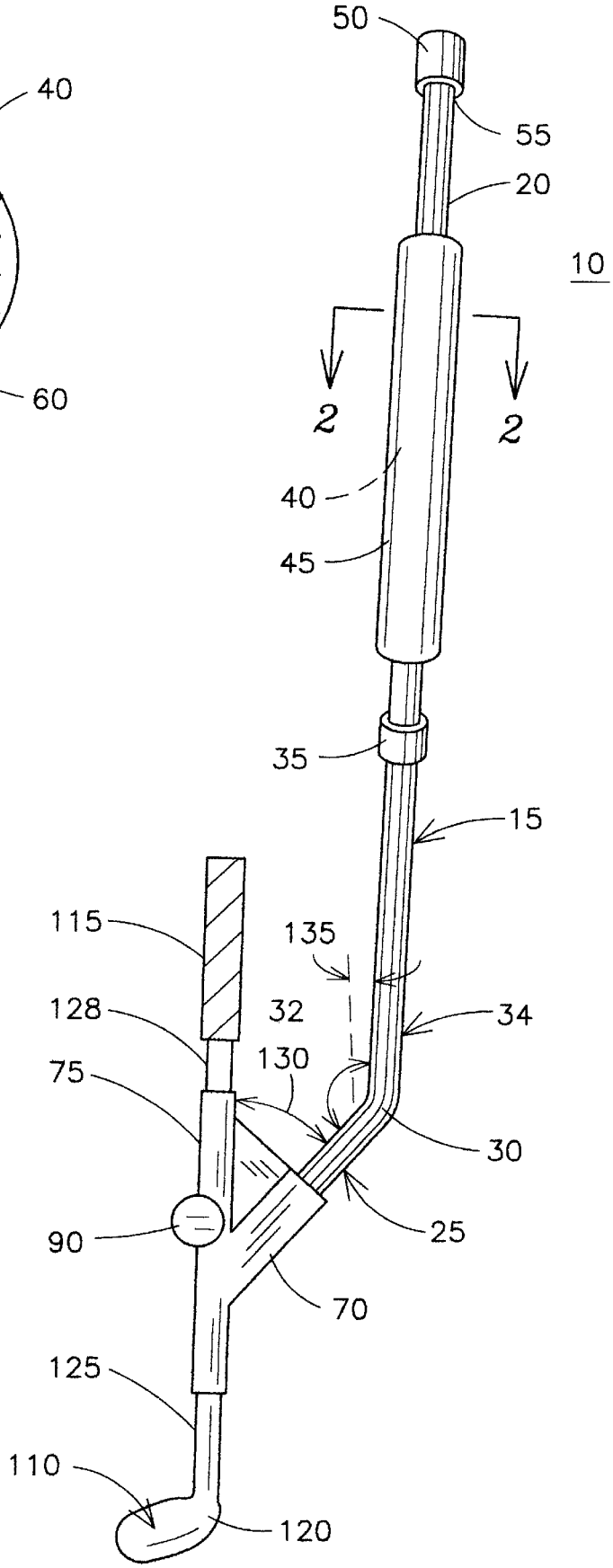
FIG. 1 depicts a side elevational view of the training aid of the present invention attached to a club.

FIG. 1 illustrates one form of a golf training aid 10 in accordance with the teachings of the present invention. The aid 10 includes an elongated, shaped shaft 15, preferably tubular and metallic, although polymeric materials or wood could be used. Guide 15 includes an upper segment 20 and an angled lower segment 25 separated by an elbow 30 and an intermediate segment 34. The angle of separation 32 between the segment 34 and the lower segment 25 may be approximately 135°.

Figure 5:
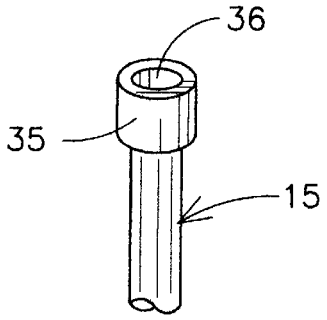
FIG. 5 is a perspective view of the flexible shaft connector.

A cylindrical flexible connector 35 connects the upper segment 20 to the intermediate segment 34. Connector 35 may be a tubular member having a central passageway 36 (see FIG. 5) adapted for tightly fitting over a lower end of upper shaft segment 20 and an upper end of intermediate segment 34 so as to establish a non-rigid relationship between the upper segment 20 and the remainder of the shaft. Connector 35 may be composed of a hard rubber material or any other suitable material known in the art. This connector 35 allows the shaft 15 to flex as the golfer addresses the golf ball, thereby enabling the golfer to position his or her arms correctly without discomfort from angular orientation of the shaft segment 20 in the golfer's armpit as will be described.

A tubular sleeve 40 slidably fits around the upper segment 20 above connector 35. The tubular sleeve 40 is preferably cylindrical and covered by a resilient pad 45, such as a polymeric foam material.

The tubular sleeve 40 has an inner diameter slightly larger than the outer diameter of shaft segment 20 such that the sleeve 40 slides freely on shaft segment 20. An upper stop 50 retains sleeve 40 on shaft segment 20 and may comprise a conventional rubber end cap placed over top 55 of segment 20. Connector 35 limits the downward movement of sleeve 40 on shaft 15. Preferably, the sleeve 40 has about 5 inches of movement on segment 20 so as to accommodate different size persons. Typically, the sleeve 40 may be about 10 inches in length.

Figure 2:
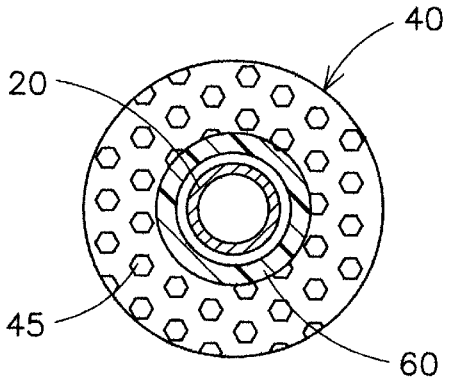
FIG. 2 shows an enlarged cross-sectional view of one embodiment of the training aid along lines 57—57 of FIG. 1.

FIG. 2 shows a cross-sectional view of the training aid along lines 2—2 of FIG. 1 in which the tubular member 40 includes an inner cylinder 60 that is slidably positioned on upper segment 20. This cylinder 60 is preferably composed of a polymeric material such as polyvinyl chloride and a foam pad 45 is stretched or bonded over the cylinder 60. The sliding sleeve makes the training aid 10 more flexible by allowing the tubular sleeve 40 to move with the golfer during the stroke, preventing the guide 15 from pulling the golfer's shoulder out of proper alignment during a stroke and assuring that a desired relationship is maintained between the golfer and a club to which the guide is attached.

It is contemplated that guide 15 be separable at connector 35 so as to allow for ease of storage of the guide in a golf bag. For example, the connector 35 may include a threaded insert and the mating end of either or both of segments 20 and 34 may incorporate a threaded fitting to engage the insert, such as in the manner of a conventional pool cue. Other forms of separable connection such as a splined slip-fit may also be used.

Referring again to FIG. 1, lower segment 25 is rigidly connected to housing 70 which in turn is integrally formed with elongated member 75. Elongated member 75 is preferably formed from cast metal such as aluminum or may be made from a polymeric material. Lower segment 25 and intermediate segment 34 can be molded with housing 70 or attached by any number of conventional means including a conventional epoxy bonding such as used to attach club heads to club shafts or by a threaded member, a rivet, or any other fastener known in the art. The housing 70 and member 75 form a connector 77 for attaching the guide 10 to a club shaft.

Figure 3:
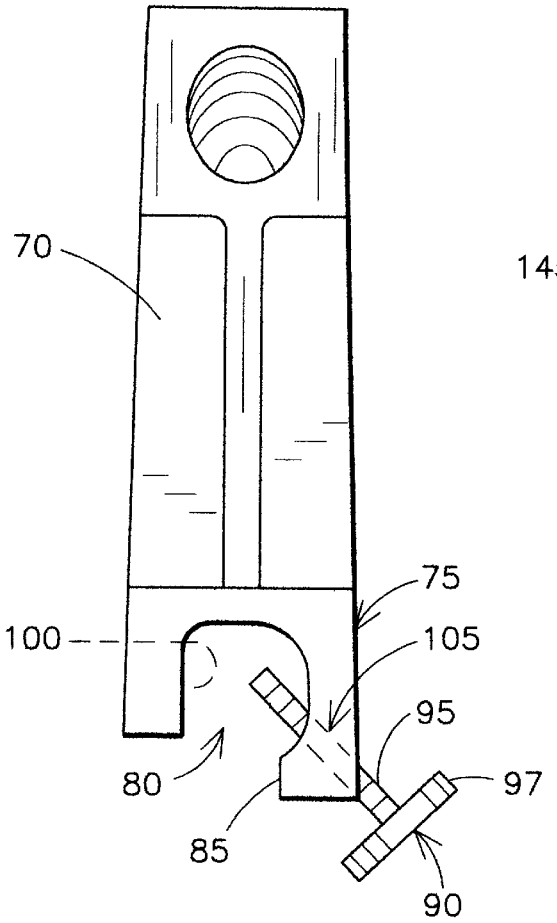
FIG. 3 depicts a top close view of the housing.

FIG. 3 is a close-up view of the connector 77 for attaching the golf training aid 10 to a golf club. Elongated member 75 defines a generally semi-circular or C-shaped groove 80 which is sized so as to fit most conventional club shafts. Ridge 85 encloses one side of groove 80 and is pierced by a threaded aperture 105 for receiving a threaded member 90. THreaded member 90 is preferably a bolt or similar fastener which includes elongated shank 95 and large head 97 for manual adjustment. Shank 95 may be adjustably extended by rotation into groove 80 so as to press the club shaft firmly against distal wall 100 thereby ensuring that the club shaft remains in a desired orientation and placement. Member 75 and member 90 form a releasable and adjustable clamp for attachment of the guide 15 to a golf club shaft.

Referring again to FIG. 1, a golf club 110, such as a putter or chipping iron, includes a grip 115, blade 120, and shaft 125. Attachment area 128, which is preferably within about one to two inches below gripping end or grip 115, demonstrates a preferred site of attachment of golf training aid 10 on shaft 125, but changes in the location can be made to account for the height and comfort of the individual user. Lower end 25 forms angle 130 with the shaft 125. Angle 130 may be approximately 45°, although a range of angles is acceptable depending on the shaft used. Upper end 20 may be bent approximately 40° out of alignment with club shaft 125 as indicated by angle 135. Angle 135 may also be a range of values depending on the particular shaft used. Conventional clubs have different angles between the head and the shaft. Golf training aid 10 can be attached to practically all clubs since it can be rotated around the shaft for proper positioning of guide 15 under the user's arm. This rotation feature provides an advantage over other golf aids that only extend the club shaft.

Figure 4:
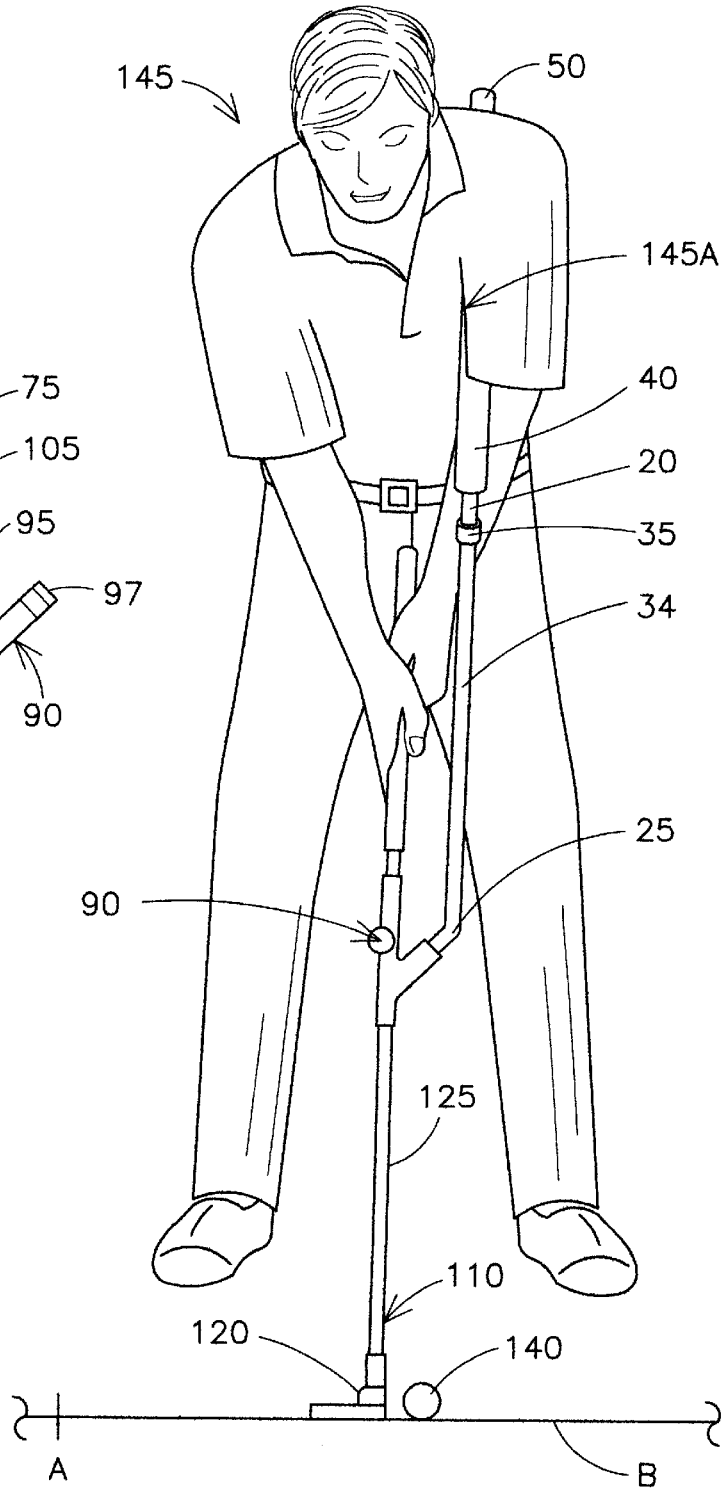
FIG. 4 demonstrates the invention of FIG. 1 in use.

A method of using golf training aid 10 is best illustrated in FIG. 4, and includes positioning shaft 125 of club 110 within groove 80 (see FIG. 3) of elongated member 75. The guide 15 is placed over the forearm and through the armpit so that member 40 is sandwiched in the armpit of the golfer 145, preferably in the forward armpit 145A of the golfer 145. Club shaft 125 is rotated until blade 120 is properly aligned to golf ball 140 and is correctly positioned for golfer 145, whereupon threaded member 90 is tightened. If needed, shaft 125 can be adjustably rotated to confirm that the alignment of blade 120 is proper. Golfer 145 then addresses golf ball 140, positioning blade 120 behind the ball 140. At this point, the upper arm of the golfer presses inwardly on the upper segment 20 when the club 110 is held correctly. This pressure is absorbed through flex connector 35 which allows segment 20 to bend with respect to segment 34 thus maintaining correct angles and making the guide more comfortable. During the stroke, the sleeve 40 allows the segment 20 (and shaft 15) to extend and retract so that the shoulders are not forced out of position by a fixed distance between the hands and shoulders. For example, if the club is pulled back to about point A and maintained parallel to line B, the golfer's hand position will extend away from the golfer's left shoulder. Without the sliding sleeve 40, the shoulder would be pulled out of alignment and create an improper stroke.

During all phases of the stroke, training aid 10 forces the golfer 145 to maintain the correct form and posture to help ensure a straight and proper shot. Specifically, the golfer's torso and shoulders are made to rotate about his spine as the stroke is made, and the golfer's wrists are prevented from "breaking" from the desired linear alignment.

Upon repetitive use, muscle memory develops, and golf training aid 10 can be removed, and the learned technique continues automatically for a smoother, uniform golf stroke. While the invention has been described in what is presently considered to be a preferred embodiment, various modifications and improvements will become apparent to those skilled in the art. It is intended therefore that the invention not be limited to the specific disclosed embodiment but be interpreted within the full spirit and scope of the appended claims.

I claim:

1. A golf training aid for establishing an idealized golf club position and swing path for short golf swings comprising:

means for attachment to a golf club;

a shaped, elongate shaft having one end coupled to said attachment means and having an opposite end adapted for positioning through an armpit of a user; and a flexible connector coupling an upper end of said shaft to a lower end thereof.

2. The golf training aid of claim 1 further comprising a sliding tubular member positioned on said upper end of said shaft for placement under the arm of a user.

3. The golf training aid of claim 2 wherein said sliding member is operable to slide along said shaft between said connector and a stop located proximate a top of said shaft.

4. The golf training aid of claim 1 wherein said shaft comprises an upper segment and a lower segment, said lower segment extending away from an axis of said upper segment at an angle of approximately 135°.

5. The golf training aid of claim 1 wherein said attachment means comprises:

an elongated member adapted for receiving an end of said shaft therein; and clamping means for releasably coupling said attachment means to a golf club shaft.

6. The golf training aid of claim 1 wherein said training aid is separable at said flexible connector.

7. A golf training aid comprising:

a) means for attachment to a putter shaft;

(b) an underarm guide connected to said attachment means and fitting contiguously between a user's arm and body to allow the user to assume a correct posture with the putter correctly addressing the ball; and (c) a slidable sleeve mounted on said guide for positioning in the user's underarm for allowing movement of the user's hands away from and toward the underarm during a stroke.

8. The golf training aid of claim 7 wherein said sleeve comprises an inner, generally rigid tube and an outer polymeric foam covering over said tube.

9. The golf training aid of claim 8 wherein said guide comprises an elongate shaft having an upper segment, a lower segment and an intermediate segment, and wherein said upper segment connects to said intermediate segment through a flexible connector.

10. The golf training aid of claim 9 wherein said connector comprises a relatively stiff polymeric tube, adjacent ends of each of said upper and intermediate segments being grippingly seated in a central aperture of said tube.

* * * * *